US011313259B2

(12) United States Patent
Jo et al.

(10) Patent No.: US 11,313,259 B2
(45) **Date of Patent: *Apr. 26, 2022**

(54) LINKAGE BETWEEN AN AUXILIARY MOTION SOURCE AND A MAIN MOTION LOAD PATH IN AN INTERNAL COMBUSTION ENGINE

(71) Applicant: Jacobs Vehicle Systems, Inc., Bloomfield, CT (US)

(72) Inventors: Peter Jo, Rocky Hill, CT (US); Justin Baltrucki, Canton, CT (US); David Ferreira, Glastonbury, CT (US); Neenad Wamane, Bloomfield, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 14 days.

This patent is subject to a terminal disclaimer.

(21) Appl. No.: 16/796,653

(22) Filed: Feb. 20, 2020

(65) Prior Publication Data

US 2020/0191027 A1 Jun. 18, 2020

Related U.S. Application Data

(63) Continuation of application No. 14/735,247, filed on Jun. 10, 2015, now Pat. No. 10,626,763.

(Continued)

(51) Int. Cl.
*F01L 1/18* (2006.01)
*F01L 13/06* (2006.01)

(Continued)

(52) U.S. Cl.
CPC ..... *F01L 13/065* (2013.01); *F01L 1/267* (2013.01); *F01L 9/12* (2021.01); *F01L 13/0036* (2013.01);

(Continued)

(58) Field of Classification Search
CPC ..... F01L 13/065; F01L 9/023; F01L 1/267; F01L 1/2411; F01L 1/181; F01L 1/2405; F01L 13/36
See application file for complete search history.

(56) References Cited

U.S. PATENT DOCUMENTS 2,808,818 A 10/1957 Sampietro
5,282,443 A 2/1994 Fujiyoshi et al.

(Continued)

FOREIGN PATENT DOCUMENTS

CN 102562214 A 7/2012
EP 0190418 A1 8/1986

(Continued)

OTHER PUBLICATIONS

European Search Report for European Application No. 19217828 dated Apr. 20, 2020, 7 pages.

(Continued)

*Primary Examiner* — Zelalem Eshete
(74) *Attorney, Agent, or Firm* — Moreno IP Law LLC

(57) ABSTRACT

In an internal combustion engine, a linkage is provided between an auxiliary motion source and a main motion load path, such that motions received by the linkage from the auxiliary motion source result in provision of a first force to at least one engine valve and a second force to the main motion load path in a direction toward a main motion source. Where an automatic lash adjuster is associated with the main motion load path, the second force may be selected to aid in the control of lash adjustments made by the automatic lash adjuster. In various embodiments, the linkage may be embodied in an mechanical linkage, whereas in other embodiments, an hydraulic linkage may be employed. The linkage may be incorporated into, or otherwise cooperate, a valve bridge or a rocker arm.

25 Claims, 10 Drawing Sheets

Related U.S. Application Data

(60) Provisional application No. 62/010,365, filed on Jun. 10, 2014.

(51) Int. Cl.

| | |
|---|---|
| ***F01L 13/00*** | (2006.01) |
| ***F01L 1/26*** | (2006.01) |
| ***F02D 13/04*** | (2006.01) |
| ***F01L 9/12*** | (2021.01) |
| ***F02D 9/06*** | (2006.01) |
| *F01L 1/24* | (2006.01) |

(52) U.S. Cl.

CPC ..... *F02D 9/06* (2013.01); *F02D 13/04* (2013.01); *F01L 1/181* (2013.01); *F01L 1/2405* (2013.01); *F01L 1/2411* (2013.01)

(56) References Cited

U.S. PATENT DOCUMENTS

| | | | | |
|---|---|---|---|---|
| 6,901,896 | B2 | 6/2005 | Yamamoto et al. | |
| 7,484,483 | B2 | 2/2009 | Yang et al. | |
| 7,909,015 | B2 | 3/2011 | Yang | |
| 8,042,502 | B2 | 10/2011 | Schnell | |
| 8,210,144 | B2 | 7/2012 | Langewisch | |
| 8,225,769 | B2 | 7/2012 | Dilly | |
| 8,578,901 | B2 | 11/2013 | Ruggiero et al. | |
| 8,813,719 | B2 | 8/2014 | Sailer et al. | |
| 2003/0188703 | A1 | 10/2003 | Vanderpoel | |
| 2005/0211203 | A1 | 9/2005 | Roth | |
| 2007/0095312 | A1* | 5/2007 | Vanderpoel | F01L 1/053 123/90.16 |
| 2007/0144472 | A1 | 6/2007 | Yang | |
| 2008/0006231 | A1 | 1/2008 | Noss et al. | |
| 2008/0087239 | A1 | 4/2008 | Wiley et al. | |
| 2012/0024260 | A1 | 2/2012 | Groth et al. | |
| 2014/0020644 | A1 | 1/2014 | Roberts et al. | |
| 2014/0020654 | A1* | 1/2014 | Yang | F01L 1/20 123/323 |
| 2014/0109848 | A1 | 4/2014 | Janak et al. | |

FOREIGN PATENT DOCUMENTS

| | | | |
|---|---|---|---|
| EP | 2439381 | A1 | 4/2012 |
| JP | H0726522 | B2 | 3/1995 |
| JP | 2005009451 | A | 1/2005 |
| JP | 2005054589 | A | 3/2005 |
| JP | 4021730 | B2 | 12/2007 |
| WO | 2010078280 | A2 | 7/2010 |
| WO | 2012162616 | A1 | 11/2012 |
| WO | 2013136508 | A1 | 9/2013 |
| WO | 2014001560 | A1 | 1/2014 |
| WO | 2015120897 | A1 | 8/2015 |

OTHER PUBLICATIONS

Extended European Search Report for European Patent Application No. 158906790.0 dated Jan. 9, 2018, 9 pages.

International Search Report and Written Opinion, dated Aug. 28, 2015, filed in PCT/US2015/035012, 14 pages.

* cited by examiner

LINKAGE BETWEEN AN AUXILIARY MOTION SOURCE AND A MAIN MOTION LOAD PATH IN AN INTERNAL COMBUSTION ENGINE

CROSS-REFERENCE TO RELATED APPLICATION

The instant application is a continuation of U.S. patent application Ser. No. 14/735,247, filed Jun. 10, 2015 and entitled "LINKAGE BETWEEN AN AUXILIARY MOTION SOURCE AND A MAIN MOTION LOAD PATH IN AN INTERNAL COMBUSTION ENGINE," which prior application claims the benefit of Provisional U.S. Patent Application Ser. No. 62/010,365, filed Jun. 10, 2014 and entitled "Hydraulic Lash Adjuster," the teachings of which prior applications are incorporated herein by this reference.

FIELD

The instant disclosure relates generally to internal combustion engines and, in particular, to techniques for providing motions to engine valves within such internal combustion engines.

BACKGROUND

Compression release braking, or engine braking, may be employed to assist and supplement wheel brakes in slowing heavy machines, such as, on-highway trucks, construction machines, earthmoving machines, and the like. As known in the art, compression release braking converts an internal combustion engine from a power generating unit into a power consuming air compressor through selective control of various engine valves. In an embodiment, a compression release braking system actuates a cylinder exhaust valve such that compressed air from the compression stroke of the engine is released through the exhaust valve when the piston in the cylinder nears the top-dead-center position. Generally, the exhaust valve is actuated by a rocker arm that, in turn, is often operatively connected to the exhaust valve by way of a valve bridge. The rocking motion of the rocker arm presses down on the valve bridge (or directly on the valve) which in turn opens the exhaust valve, releasing the compressed air.

An automatic lash adjuster or, in most instances, an hydraulic lash adjuster (referred to hereinafter as an automatic lash adjuster) is often disposed in the rocker arm or elsewhere in the valvetrain, e.g., directly on or above the valve bridge, so as to maintain zero clearance (or lash) between the rocker arm and the valve or valve bridge during positive power generation by the engine. Examples of hydraulic lash adjusters may be found in U.S. Pat. No. 2,808,818 and European Patent Application Publication No. 0190418A1. An example of a mechanical automatic lash adjuster may be found in International Patent Application Publication No. WO2013136508A1. The teachings of these reference are incorporated herein by this reference. Using an hydraulic lash adjuster as an example, the automatic lash adjuster may include a hollow, sliding plunger operated by a hydraulic fluid, such as engine oil. When the engine valve is closed, the automatic lash adjuster may be free to fill with the hydraulic fluid, expanding the automatic lash adjuster and thereby taking up lash space as it expands. When the lash adjuster is loaded, the fluid supply to the hydraulic lash adjuster may be blocked and fluid pressure within the automatic lash adjuster prevents the plunger from collapsing. In this manner, the automatic lash adjuster is able to take up any lash space between components used to actuate an engine valve.

An example of such a system 100 is schematically illustrated in FIG. 1. In particular, the system comprises a main motion source 102 used to actuate (or provide motions to) one or more engine valves 104 via a main motion load path or valve train 106. As used herein, a motion source is any component that dictates the motions to be applied to an engine valve, e.g., a cam. Conversely, a motion load path or valve train comprises any one or more components deployed between a motion source and an engine valve and used to convey motions provided by the motion source to the engine valve, e.g., tappets, rocker arms, pushrods, valve bridges, automatic lash adjusters, etc. Furthermore, as used herein, the descriptor "main" or "primary" refers to features of the instant disclosure concerning so-called main event engine valve motions, i.e., valve motions used during positive power generation, whereas the descriptor "auxiliary" refers to features of the instant disclosure concerning auxiliary engine valve motions, i.e., valve motions used during engine operation other than conventional positive power generation (e.g., compression release braking, bleeder braking, cylinder decompression, brake gas recirculation (BGR), etc.) or in addition to conventional positive power generation (e.g., internal exhaust gas recirculation (IEGR), variable valve actuations (VVA), Miller/Atkinson cycle, swirl control, etc.). An auxiliary motion source 108 is also provided to impart auxiliary motions to the one or more valves 104.

As further shown, an optional automatic lash adjuster 110, 112 may be associated with the main motion load path 106. As used herein, an automatic lash adjuster is "associated" with a motion load path to the extent that it is used to take up lash in the motion load path, and operates either directly within, or parallel to, the motion load path. This is illustrated in FIG. 1 where a first optional automatic lash adjuster 110 is illustrated in-line relative to the main motion load path 106, or a second optional automatic lash adjuster 112 is positioned parallel to the main motion load path 106.

As noted above, compression release engine braking requires opening of an exhaust valve during compression strokes of a cylinder. Given the very high pressures within the cylinder during compression strokes, the force required to open the exhaust valve is relative high. Consequently, the auxiliary motion source 108 and any intervening components along an auxiliary motion load path must be constructed to withstand the comparatively high forces required to open the exhaust valve, i.e., they are commensurately larger thereby increasing manufacturing costs and weight.

Additionally, during valve opening for compression release braking operation, a force or load by the motions imparted by the rocker arm is removed from the automatic lash adjuster. Because this force is absent, the automatic lash adjuster may be free to over-extend or pump-up, i.e., "jacking," resulting in the plunger excessively protruding from the automatic lash adjuster. As a result, the engine valve may be prevented from fully seating. The partial opening of a valve may ultimately result in poor performance and/or emissions and, in some instances, catastrophic valve-to-piston impact.

Thus, it would be advantageous to provide systems that address these shortcomings of existing systems.

SUMMARY

The instant disclosure describes a system in which a linkage is provided between an auxiliary motion source and a main motion load path, such that motions received by the linkage from the auxiliary motion source result in provision of a first force to at least one engine valve and a second force to the main motion load path in a direction toward a main motion source. In this manner, the force required to open an engine valve may be shared between the auxiliary motion source the main motion source (via the main motion load path). Such load sharing permits components that are used to provide the auxiliary motions to the valve to be designed less robustly, i.e., lighter and cheaper. Additionally, in those instances in which an automatic lash adjuster is associated with the main motion load path, the second force may be used to control lash adjustment, e.g., to limit or prevent jacking, during auxiliary operations such as engine braking. In various embodiments, examples of which are described below, the linkage may be embodied in a mechanical linkage, whereas in other embodiments, an hydraulic linkage may be employed.

In embodiments described below, the system may comprise a valve bridge operatively connecting at least two engine valves to a main motion load path. In one embodiment, the valve bridge may comprise an auxiliary motion receiving surface that is configured to induce rotation of the valve bridge responsive to motions received from the auxiliary motion source, such that the induced rotation provides the second force. The auxiliary motion receiving surface may be configured to limit such induced rotation of the valve bridge as well. Further still, the auxiliary motion receiving surface may be configured to be farther from or closer to (relative to a location where the valve bridge operatively connects to a first engine valve of the at least two engine valves) a point on the valve bridge where the main motions are applied to the valve bridge. In all embodiments described herein involving rotation of the valve bridge, a pivot member may be provided to be rotatably received in an opening in the valve bridge, the pivot member further comprising a receptacle for receiving the first engine valve.

In various embodiments incorporating the valve bridge, a lever arm may be provided in which a first end of the lever arm is configured to receive motions from the auxiliary motion source and a second end is configured to impart the second force. Various points on the valve bridge, including a slidable bridge pin or a connection point between the valve bridge and lever arm, may serve as a fulcrum point for the lever arm. In an embodiment, the second end of the lever arm may be rotatably coupled to the valve bridge. In further embodiments, the lever arm may be coupled to another component in the main motion load path or configured to be positioned between the valve bridge and another component in the main motion load path. A resilient element may be provided between the lever arm and the valve bridge.

Further still, the valve bridge may be provided with an hydraulic circuit in communication with a first piston bore and a second piston bore, also in the valve bridge, having first and second pistons, respectively, disposed therein. In this embodiment, the first piston is aligned with the auxiliary motion source and the second piston is configured to provide the second force. Motion applied by the auxiliary motion source is conveyed by the first piston, acting as a master piston, to the second piston, acting as a slave piston, thereby providing the second force. In another embodiment, a third bore in communication with the hydraulic circuit may be provided having a third piston disposed therein and aligned with a first engine valve of the two engine valves. In this case, the third piston also acts as a slave piston, thereby providing the first force.

In further embodiments described below, the system may comprise a rocker arm operatively connected to an engine valve. In such embodiments, the linkage may be embodied as a lever arm contacting the rocker arm, the lever arm once again having a first end configured to receiving motions from the auxiliary motion source and a second end configured to impart the second force. In these embodiments, a fulcrum point for the lever arm may be provided by a portion of an engine valve, a portion of the rocker arm itself and/or a connection point between the lever arm and the rocker arm. The lever arm may contact the rocker arm on either a motion imparting end of the rocker arm or a motion receiving end of the rocker arm. Further still, a travel limiter may be provided to limit travel of the rocker arm in response to the second force.

In yet further embodiments, an automatic lash adjuster may be associated with the main motion load path. In various embodiments, the linkage may be configured to apply the second force to the main motion load path at a point in the main motion load path between the automatic lash adjuster and the at least one engine valve. Furthermore, the linkage may be configured such that the second force provided thereby is sufficient to control lash adjustment by the automatic lash adjuster.

BRIEF DESCRIPTION OF THE DRAWINGS

The features described in this disclosure are set forth with particularity in the appended claims. These features will become apparent from consideration of the following detailed description, taken in conjunction with the accompanying drawings. One or more embodiments are now described, by way of example only, with reference to the accompanying drawings wherein like reference numerals represent like elements and in which:

DETAILED DESCRIPTION OF THE PRESENT EMBODIMENTS

Figure 1:
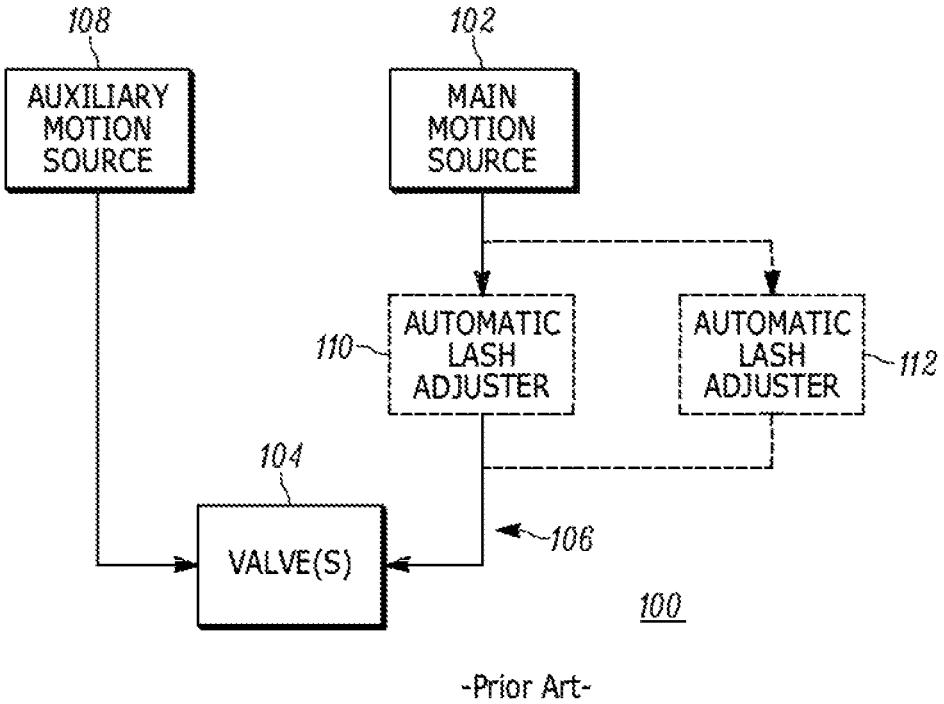
FIG. 1 is a schematic block diagram of a system in accordance with prior art techniques.
Figure 2:
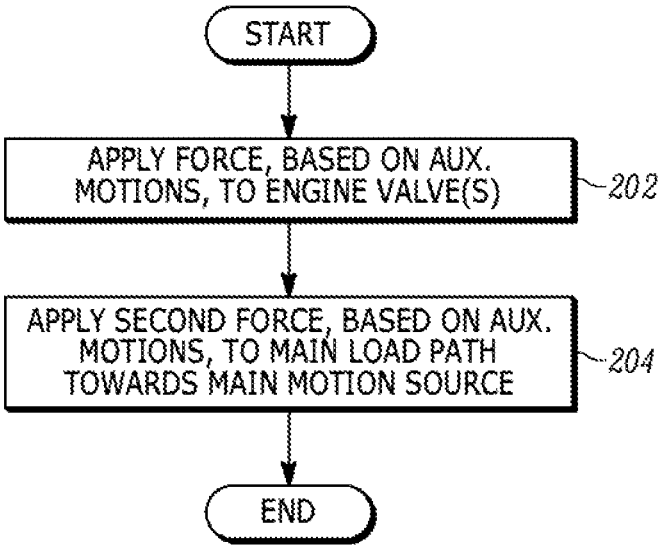
FIG. 2 is a flowchart of a method for actuating at least one engine valve in accordance with the instant disclosure.
Figure 3:
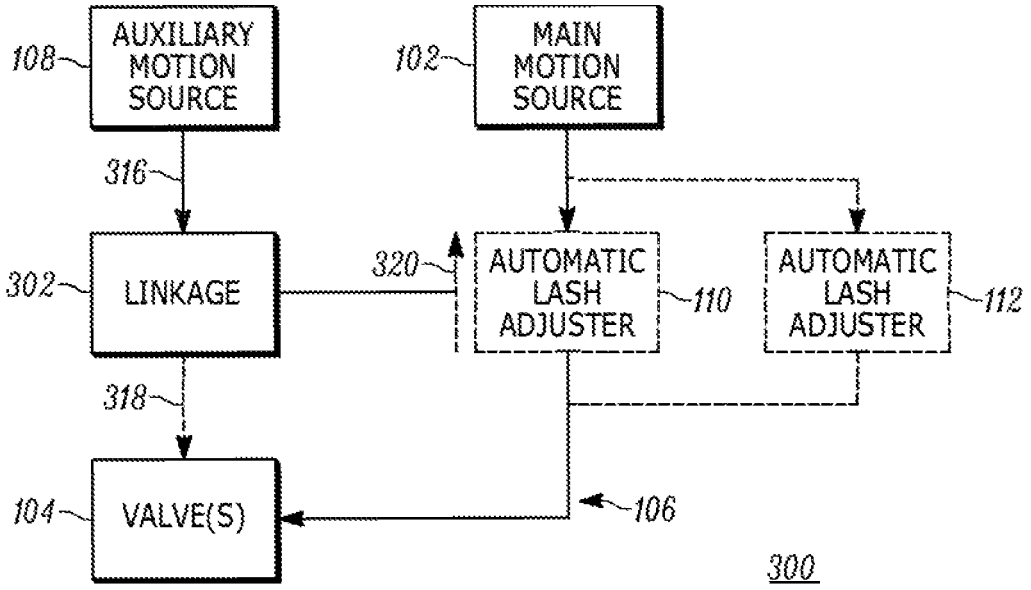
FIG. 3 is a schematic block diagram of a system in accordance with the instant disclosure.

Referring now to FIGS. 2 and 3, a method and system for actuating one or more engine valves in an internal combustion engine is further described. As known in the art, internal combustion engines typically comprise one or more cylinders having pistons disposed therein, as well as one or more engine valves used, during positive power generation, to intake air and/or fuel into the cylinder and to exhaust the resulting combustion gases. As further known, auxiliary valve motions, such as those required to implement compression release braking described above, can be implemented through suitable control of the engine valves by an auxiliary motion source.

At block 202 of FIG. 2, a first force is applied to at least one engine valve, which first force is based on motions provided by an auxiliary motion source. With reference to FIG. 3, the system 300 comprises an auxiliary motion source 108 that, as described above, may comprise a cam or similar component that dictates the auxiliary motions 316 to be applied to the one or more engine valves 104. As shown in FIG. 3, the auxiliary motions 316 are provided to a linkage 302 that, in turn, provides the first force 318 to the engine valve(s) 104. The first force is sufficient to open the one or more valves 104 as required for the auxiliary motions.

Referring once again to FIG. 2, at block 204, a second force is applied to the main motion load path in direction toward the main motion source, which second force is also based on the motions provided by the auxiliary motion source. Although, blocks 202 and 204 are illustrated in serial fashion for ease of explanation, in practice, application of the first and second forces will occur essentially simultaneously, though this is not requirement of the instant disclosure. With reference to FIG. 3, this is schematically depicted by the linkage 302 giving rise to the second force 320, based on the input auxiliary motions 316, which second force 320 is applied to the main motion load path 106 in a direction toward to the main motion source 102. As depicted in FIG. 3 and the remaining Figures, the auxiliary motions 316 are shown using a heavy, solid arrow, whereas the first force 318 is depicted using a heavy, dashed and dotted arrow and the second force 320 is depicted using a heavy, dashed-only arrow. It is further noted that the second force 320 is schematically depicted in FIG. 3 alongside the main motion load path 106 to illustrate the fact the second force 320 can be applied at any point along the main motion load path 106. By applying the second force 320 to the main motion load path 106, the equal and opposite force provided by the main load path 106 in opposition to the second force 320 may be employed by the linkage 302 to facilitate movement of the engine valve(s) 104. In other words, the linkage 302 may facilitate sharing of the forces required to open the one or more valves 104 between the auxiliary motion source 108 and the main motion source 102 and/or their respective motion load paths.

In the event that the main motion load path 106 has an automatic lash adjuster 110, 112 associated therewith, the second force 320 may be applied to the main motion load path 106 at a point between automatic lash adjuster 110, 112 and the one or more valves 104. Because the second force 320 is applied to the main motion load path 106 in a direction toward the main motion load source 102 and, consequently in this scenario, the automatic lash adjuster 110, 112, the second force 320 may be used to also control lash adjustment by the automatic lash adjuster 110, 112. For example, it may be desirable for the second force 320 to be greater than the maximum force provided by the automatic lash adjuster during extension thereof. Using the linkage 302, the magnitude of the second force 320 can be selected in order to provide the desired load sharing and/or control of the automatic lash adjuster 110, 112. FIGS. 4-17, described in greater detail below, illustrate various implementations of the linkage 302.

Figure 4:
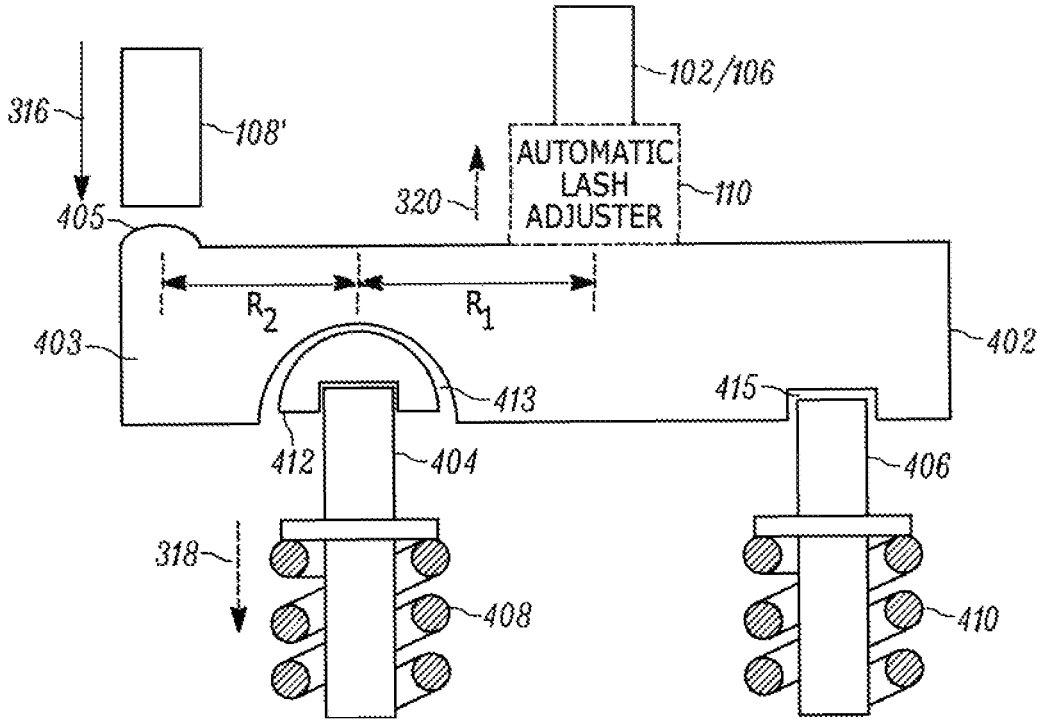
FIGS. 4-14 are schematic illustrations of various embodiments based on valve bridges in accordance with the instant disclosure.

Referring now to FIG. 4, an embodiment of a linkage 302 in the form of a valve bridge 402 is further illustrated. The valve bridge 402, which may be fabricated from materials typically used to manufacture such components, is configured to receive at least two engine valves 404, 406 (only the valve stems shown) in corresponding, schematically-illustrated receptacles or openings 413, 415. In keeping with prior art systems, valve springs 408, 410 are provided to maintain the engine valves 404, 406 in a normally closed state. FIG. 4 also illustrates an optional automatic lash adjuster 110 positioned in-line with the main motion load path 106. It is noted that the various optional automatic lash adjusters illustrated in FIGS. 4-17 are of conventional structure and operation and the instant disclosure is not limited by their particular implementation. Furthermore, to the extent that the automatic lash adjusters 110, 112 illustrated herein require the supply of hydraulic fluid, it is assumed that conventional means of supplying such hydraulic fluid are employed. Regardless, during positive power generation, the main motion source 102 and the remainder of the main motion load path 106 (of which, the valve bridge 402 and automatic lash adjuster 110, if provided, are constituent members) causes main motions to be applied to the valves 404, 406 in the usual manner.

As further illustrated in FIG. 4, the valve bridge 402 also includes an extended region 403. In this embodiment, the extended region 403 extends past a first engine valve 404 (relative to a point of the valve bridge 402 where the main motion source 102, main motion load path 106 and/or automatic lash adjuster 110 contact the valve bridge 402) farther than a corresponding region on the opposite of side end of the valve bridge 402. Additionally, the extended region 403 comprises an auxiliary motion receiving surface 405 that is configured to axially align with an auxiliary motion source or other component forming part of an auxiliary motion load path 108'. Configured in this manner, the auxiliary motion receiving surface 405 creates a lever arrangement relative to auxiliary motion source 108' and the main motion source 102/main motion load path 106/automatic lash adjuster 110 with the first engine valve 404 serving as a fulcrum point. Consequently, when auxiliary motions are applied to the auxiliary motion receiving surface 405 in the direction shown, rotation of the valve bridge 402 is induced (e.g., in a counterclockwise direction as illustrated in FIG. 4) about the point where the first engine valve 404 contacts the valve bridge 402. In this manner the first force is applied to the first engine valve 404 while the second force is applied to the main motion source 102/main motion load path 106/automatic lash adjuster 110, as shown. In the illustrated embodiment, the auxiliary motion receiving surface 405 has a surface configured to facilitate rotation between the valve bridge 402 and the auxiliary motion source 108', which is beneficial to accommodate rotation of the valve bridge 402 relative to the surface of the auxiliary motion source 108'. Equally, a surface of the auxiliary motion source 108' may be configured in this manner relative to the auxiliary motion receiving surface 405.

As further shown, the lever arrangement thus created is governed by the lengths of the lever arms, illustrated as $R_1$ and $R_2$. As known in the art, the mechanical advantage provided by this lever arrangement may be expressed as the ratio $R_2/R_1$. Consequently, with knowledge of the force resulting from a given auxiliary motion, the lever arm lengths may be selected to cause a desired magnitude for the second force. Note that the lever arm lengths illustrated in FIG. 4 are not drawn to scale; in practice, it is anticipated that the ratio $R_2/R_1$ will be relatively small, though the actual ratios employed will depend on the particular needs of the system in question.

As further shown in FIG. 4, an optional pivot member 412 may be employed with the first engine valve 404 to facilitate rotation of the valve bridge 402. In particular, the pivot member 412 may be configured to be rotatably received in an opening 413 in the valve bridge 402, which opening is substantially centered on the longitudinal axis of the first engine valve 404. An upper or outer surface of the pivot member 412 is preferably configured to match a complementary inner surface of the opening 413, which surfaces may be rounded to facilitate rotation of the valve bridge 402.

Figure 4A:
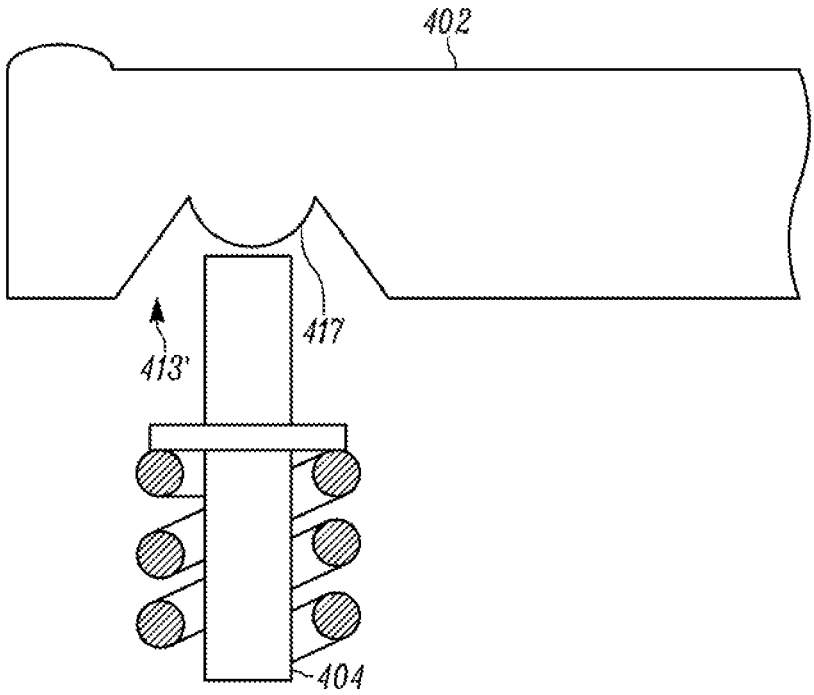

In the illustrated example, the complementary surfaces are formed to be semicircular, though this is not a requirement. For example, an alternative configuration is illustrated in FIG. 4A, in which the engine valve 404 is received in a pivot member integrally formed in the valve bridge 402; the pivot member comprising a flared opening 413' that terminates in a rounded surface 417, as shown. The greater width of the flared opening 413', as well as the rounded surface 417, permits rotation of the valve bridge 402 about the first engine valve 404. With reference once again to FIG. 4, the pivot member 412 may include a further receptacle or opening to receive the first engine valve 404 (comparable to the opening 415 used to receive the second engine valve 406).

Figure 5:
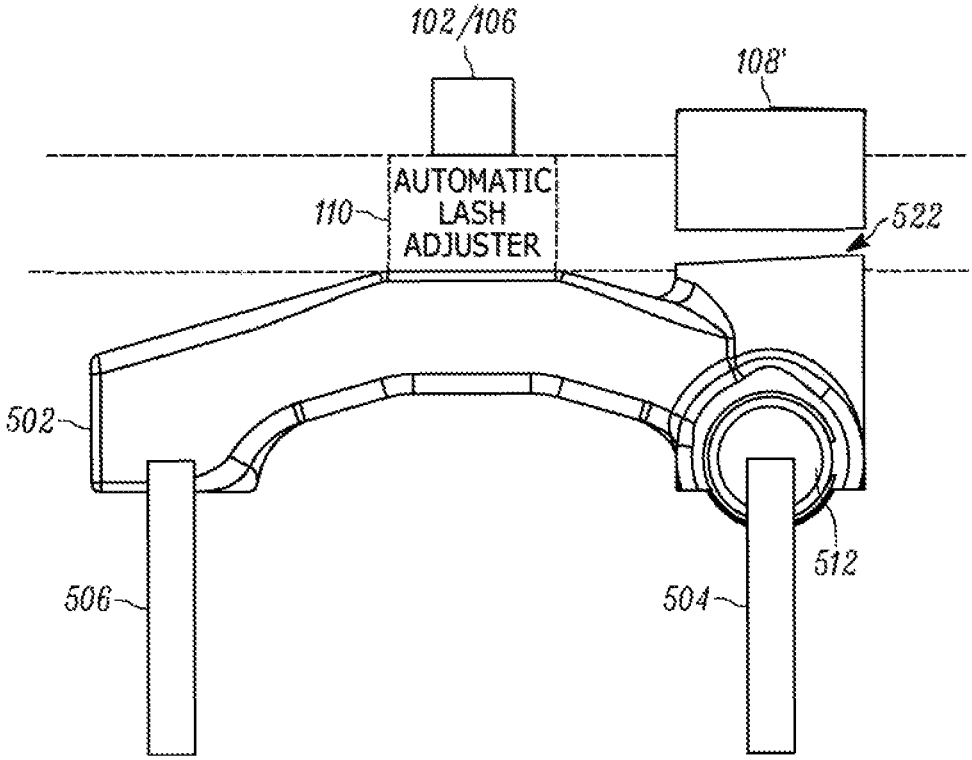
Figure 6:
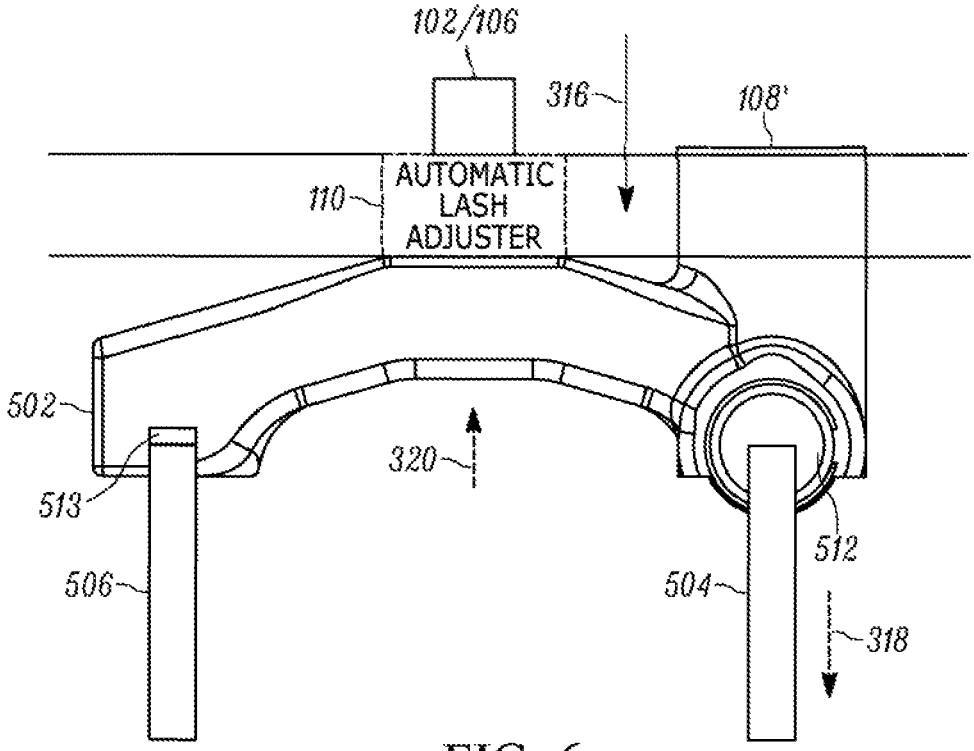

Referring now to FIGS. 5 and 6, a further valve bridge-based embodiment is illustrated. In particular, the valve bridge 502 once again includes an auxiliary motion receiving surface 522. In this embodiment, the auxiliary motion receiving surface 522 is substantially aligned with both the first engine valve 504 and the auxiliary motion source 108'. As used herein, substantially aligned refers to alignment between axes of the relevant components such that interaction between those components results in a negligible amount of rotation of either component. Thus, in this embodiment, the alignment between the auxiliary motion receiving surface 522, the first engine valve 504 and the auxiliary motion source 108' results in negligible rotation of the valve bridge 502. However, in this embodiment, rotation of the valve bridge 502 results from configuration of the auxiliary motion receiving surface 522 itself. As illustrated, an outermost edge of the auxiliary motion receiving surface 522 (relative to the central point of the valve bridge 502) has a vertical dimension (i.e., in a direction away from the first engine valve 504 and toward the auxiliary motion source 108') that is larger than a vertical dimension of an innermost edge of the auxiliary motion receiving surface 522, with the outermost and innermost edges being connected by a substantially planar surface. In short, the auxiliary motion receiving surface 522 is configured as an incline relative to an axis of the first engine valve 504 and a motion delivery surface of the auxiliary motion source 108', i.e., the lower surface of the auxiliary motion source 108' as depicted in FIGS. 5 and 6. Alternatively, or additionally, the motion delivery surface of the auxiliary motion source 108' may be inclined in a similar fashion relative to the axis of the first engine valve 504 and the auxiliary motion receiving surface 522. As before, the illustrated embodiment of FIGS. 5 and 6 may include a pivot member 512 to facilitate rotation of the valve bridge 502.

Consequently, in the illustrated embodiment, as the auxiliary motion source 108' contacts the auxiliary motion receiving surface 522, it first contacts the outermost edge thereby inducing rotation of the valve bridge 502. Note that rotation of the valve bridge 502 may result in a gap 513 between the second engine valve 506 and the valve bridge 502. Rotation of the valve bridge 502 continues in this manner until such time as the auxiliary motion source 108' encounters the innermost edge, as shown in FIG. 6. Assuming the substantially planarity of the interface between the auxiliary motion source 108' and the auxiliary motion receiving surface 522, further rotation of the valve bridge 502 will be limited. Thus, the magnitude of the motion induced by the second force will be limited, and any further motion provided by the auxiliary motion source 108' will be transmitted entirely to the first engine valve 504 alone. It is anticipated that the configuration illustrated in FIG. 6 will be particularly applicable to so-called bleeder brake applications. As known in the art, a bleeder braking system holds an exhaust valve open continuously to provide engine retardation. Consequently, such bleeder brake systems will continuously load the exhaust valve bridge (i.e., induce rotation thereof, as described above) and, in those embodiments in which an automatic lash adjuster 110 is provided, continuously load the automatic lash adjuster 110. Such continuous loading on the automatic lash adjuster 110 will cause the automatic lash adjuster 110 to eventually collapse completely, resulting in partial or complete loss of auxiliary valve opening and partial loss of subsequent main event valve opening. By configuring the auxiliary motion receiving surface 522 to limit rotation of the valve bridge 502, and consequently control the extension of the automatic lash adjuster 110, for example, complete collapse of the automatic lash adjuster 110 can be avoided under these circumstances.

Figure 7:
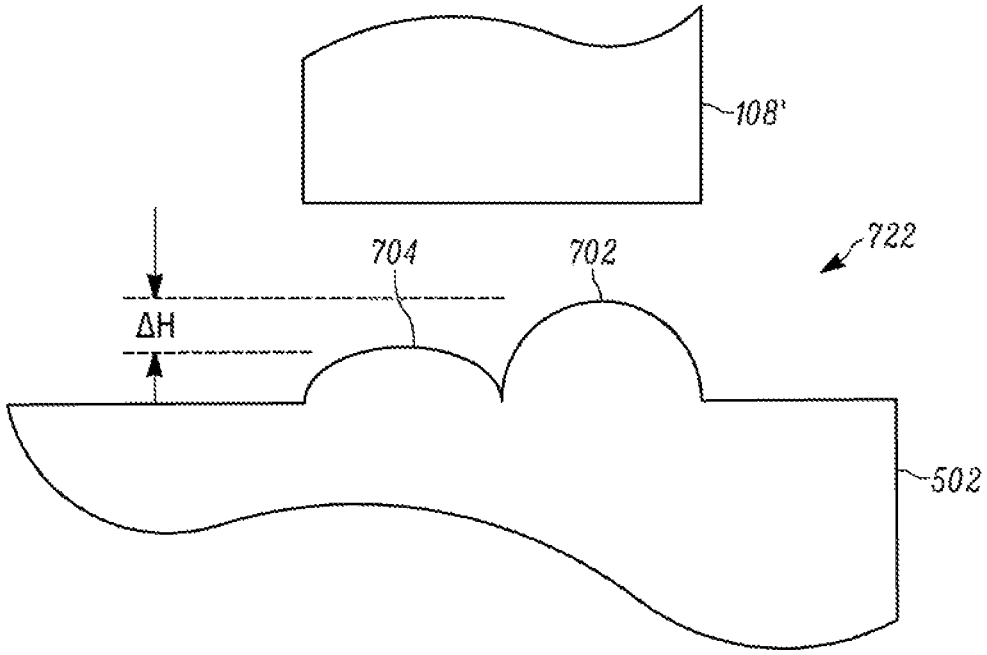

An alternative auxiliary motion receiving surface 722 is further illustrated in FIG. 7. In this embodiment, the valve bridge 502 once again has the auxiliary motion receiving surface 722 located, as in the embodiments of FIGS. 5 and 6, axially aligned with the first engine valve 504 and the auxiliary motion source 108'. However, in this embodiment, the auxiliary motion receiving surface 722 is formed of two protrusions 702, 704 having different heights. As shown, the outermost protrusion 702 has a larger vertical height than the innermost protrusion 704. Once again, as the auxiliary motion source 108' first contacts the outermost protrusion 702 and then the innermost protrusion 704, rotation of the valve bridge 502 will be limited by the difference in height ($\Delta H$) between the outermost and innermost protrusions 702, 704.

Figure 8:
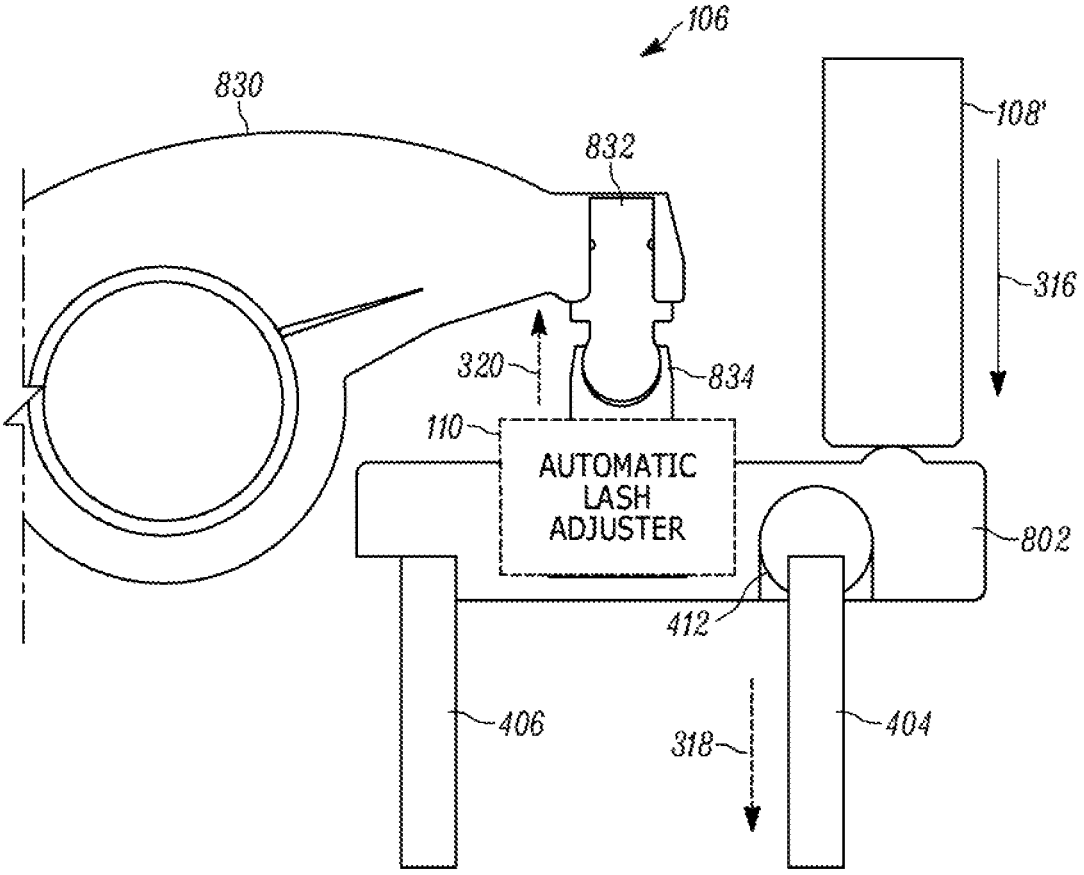

Referring now to FIG. 8, another embodiment similar to the embodiment of FIG. 4 is shown. In this embodiment, however, an automatic lash adjuster 110 is incorporated directly into a central point of the valve bridge 802, rather than simply abutting the valve bridge 802. Additionally, further details of an embodiment of the main motion load path 106 are illustrated in FIG. 8. Particularly, the main motion load path 106 comprises a rocker arm 830 having a fixed insert 832 that mates with a so-called elephant foot 834. As known in the art, the rocker arm 830, adjustment screw 832 and elephant foot 834 may be provided with hydraulic passages (not shown) used to supply hydraulic fluid to the automatic lash adjuster 110.

Figure 9:
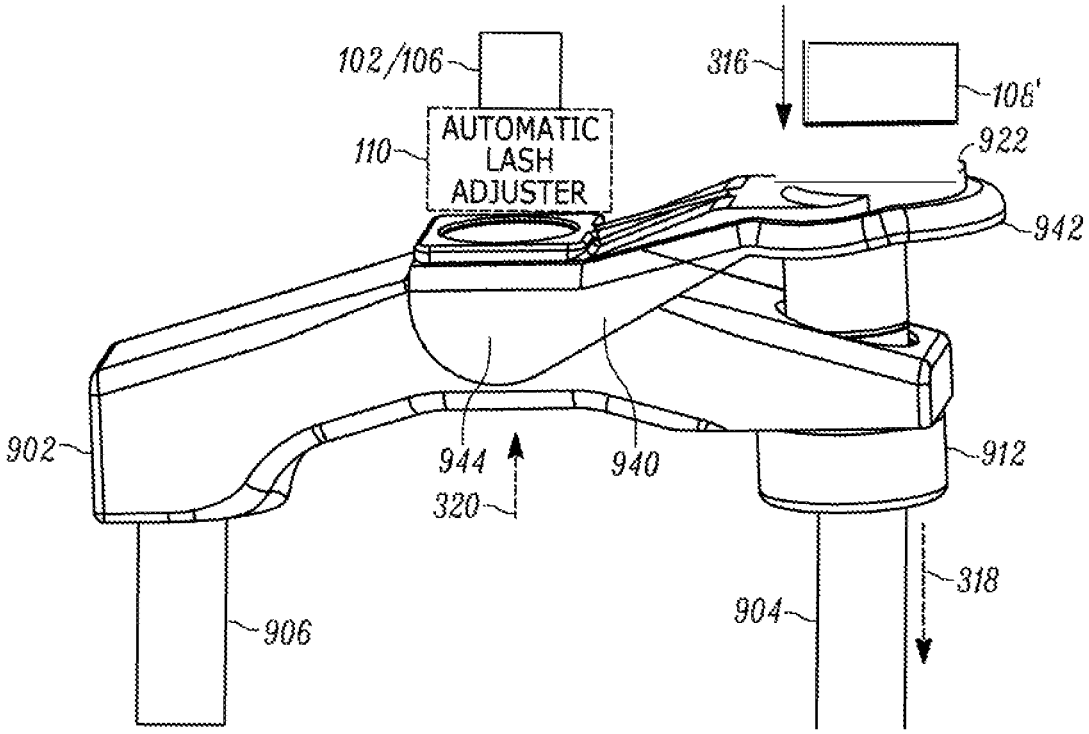

Referring now to FIG. 9, a valve bridge 902 comprises a sliding bridge pin 912, as known in the art. As shown, the valve bridge 902 is operatively connected to two engine valves 904, 906, with a first engine valve 904 coupled to the bridge pin 912. In this manner, either both engine valves 904, 906 can be actuated through the valve bridge 902 and bridge pin 912, or only the first engine valve 904 may be actuated through the bridge pin 912 only. As further shown, a lever arm 940 has a first end 942 configured to receive auxiliary motions from the auxiliary motion source 108' and a second end 944 configured to impart the second force to the main motion source 102/main motion load path 106/automatic lash adjuster 110 as shown. In the illustrated embodiment, the lever arm 940 may comprise an auxiliary motion receiving surface 922 that is configured to be offset relative to the longitudinal axes of the first engine valve 904 and bridge pin 912. Though not shown, the underside of the first end of the lever arm 940 and the upper surface of the bridge pin 912 may be configured with complementary surfaces that reduce friction and facilitate rotation therebetween. The second end 944 of the lever arm 940 contacts an upper surface of the valve bridge 902 and the lever arm 940 is free to rotate about the point at which it contacts (or is connected to) the bridge pin 912. That is, the contact/connection point between the lever arm 940 and the bridge pin 912 may serve as a fulcrum point for the lever arm 940. As the auxiliary motion source 108' imparts motions to the first end 942 of the lever arm 940, the offset of the auxiliary motion receiving surface 922 relative to the bridge pin 912 induce rotation of the lever arm 940 that, in turn, causes application of the second force to whatever component 102, 106, 110 the second end 944 is contacting.

Figure 10:
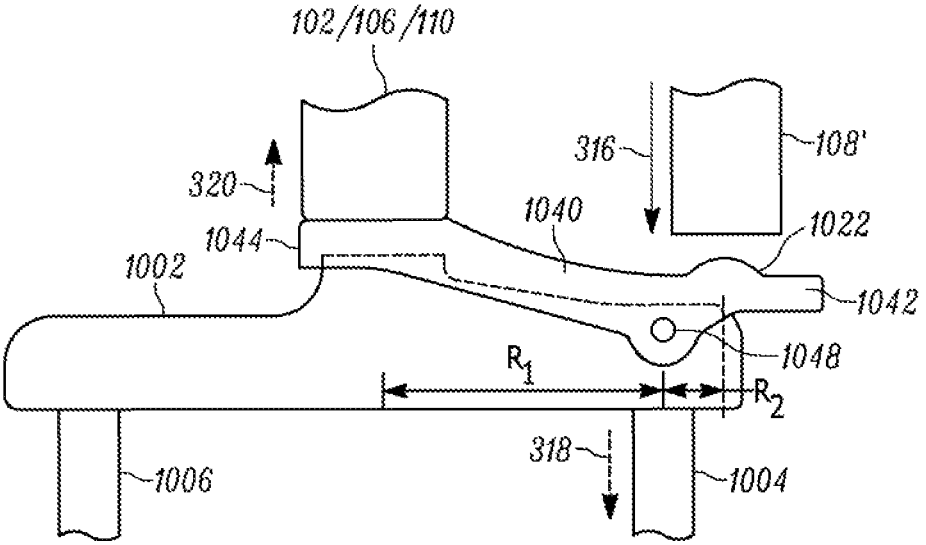
Figure 11:
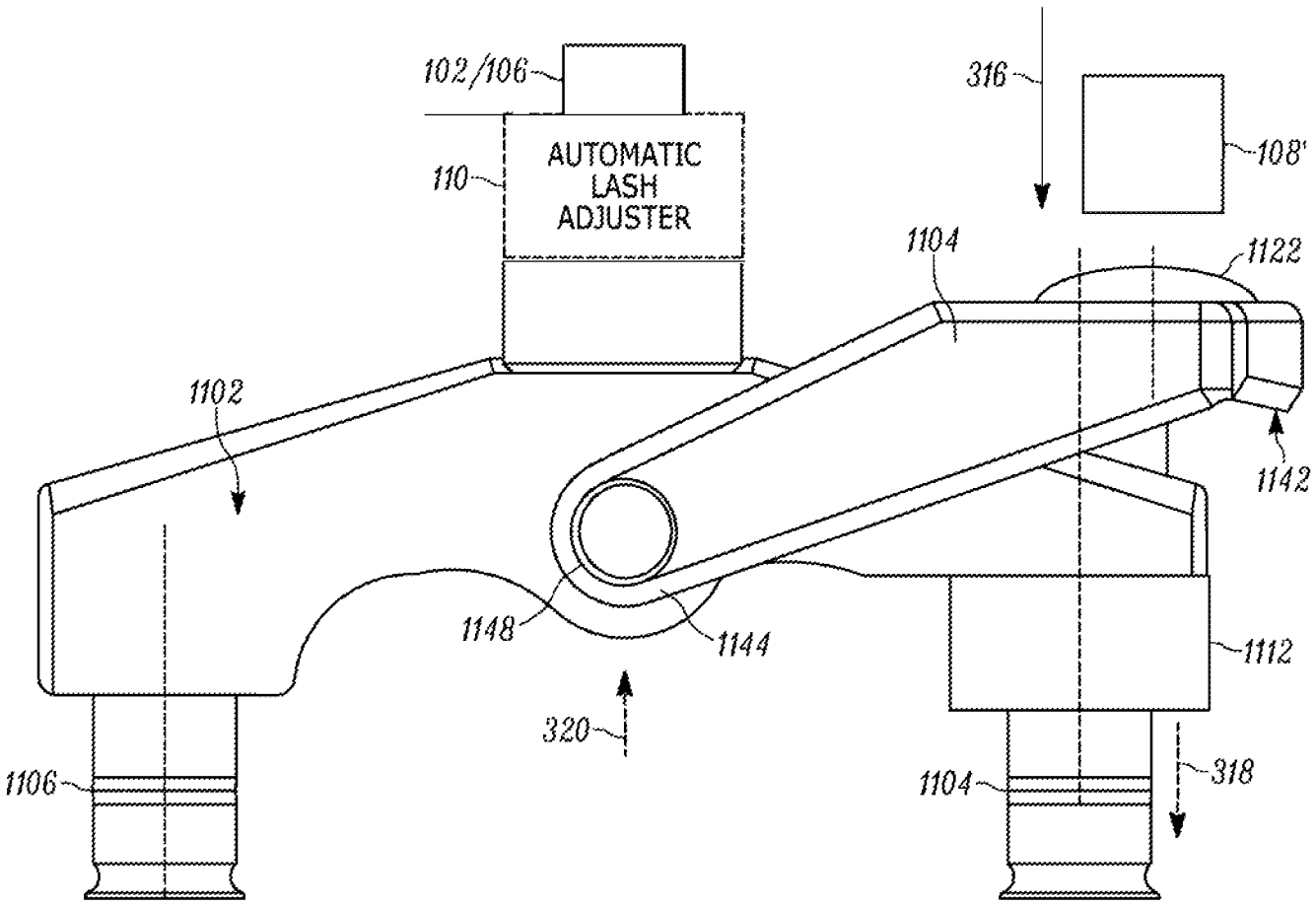

Variations on the embodiment of FIG. 9 are further illustrated in FIGS. 10 and 11. In FIG. 10, a valve bridge 1002 is provided operatively connected to first and second engine valves 1004, 1006. In this embodiment, however, no bridge pin 912 is provided. Instead, a lever arm 1040 contacts the valve bridge 1002 at a pivoting connection 1048 at a point proximate to the location where the first engine valve 1004 is operatively connected to the valve bridge 1002. The pivoting connection 1048 may comprise a pin used to secure the lever arm 1040 to the valve bridge 1002, or a groove formed in the valve bridge 1002 that receives a corresponding protuberance or similar feature formed on the inner surface of the lever arm 1040. In this manner, the lever arm 1040 is free to pivot about the pivoting connection 1048 as its fulcrum point. As shown in FIG. 10, the pivoting connection 1048 may be substantially aligned with the first engine valve 1004, though this is not a requirement. A second end 1044 of the lever arm 1040 is positioned between the valve bridge 1002 and the main motion source 102/main motion load path 106/automatic lash adjuster 110 as shown. As further shown, in this embodiment, a second end 1042 of the lever arm 1040 may comprise an auxiliary motion receiving surface 1022 aligned with the auxiliary motion source 108'. Once again, the ratio $R_2/R_1$ of the lengths of the respective arms established by the first and second ends 1042, 1044 determines the magnitude of the second force thus applied.

In the embodiment of FIG. 11, a valve bridge 1102 is provided operatively connected to first and second engine valves 1104, 1106. In this embodiment, a bridge pin 1112 is provided operatively connected to a first engine valve 1104. Additionally, a lever arm 1140 contacts the valve bridge 1002 at a pivoting connection 1148 at a point where a second end 1144 of the lever arm 1140 contacts a point of the valve bridge 1102, typically, but not necessarily, centrally located. In this manner, the lever arm 1140 is free to pivot about the pivoting connection 1048. However, in this embodiment, the pivoting connections 1148 is not the fulcrum point of the lever arm 1140. To that, an auxiliary motion receiving surface 1122 is provided on a first end 1142 of the lever arm 1140, which surface 1122 is offset relative to a longitudinal axis of the bridge pin 1112. In this manner, the bridge pin 1112 serves as a fulcrum point for the lever arm 1140 when motions are applied by the auxiliary motion source 108' to the auxiliary motion receiving surface 1122. The resulting rotation of the lever arm 1140 about the bridge pin 1112 further induces rotation of the valve bridge 1102 and application of the second force.

Although not shown in the various lever arm embodiments of FIGS. 9-11, it may be desirable to include a resilient element, such as a spring or similar component, between the lever arm 940, 1040, 1140 and the valve bridge 902, 1002, 1102 thereby slightly biasing the lever arm either away from or into contact with the valve bridge in order to avoid "slapping" between the lever arm and the valve bridge. For example, and with reference to FIG. 11, a resilient element may be placed between the lever arm 1140 and the valve bridge 1102 at a location between the pivoting connection 1148 and the bridge pin 1112. Those having skill in the art will appreciate that other locations for such a resilient element may be equally employed depending on the particular configuration of the lever arm and valve bridge in question.

Figure 12:
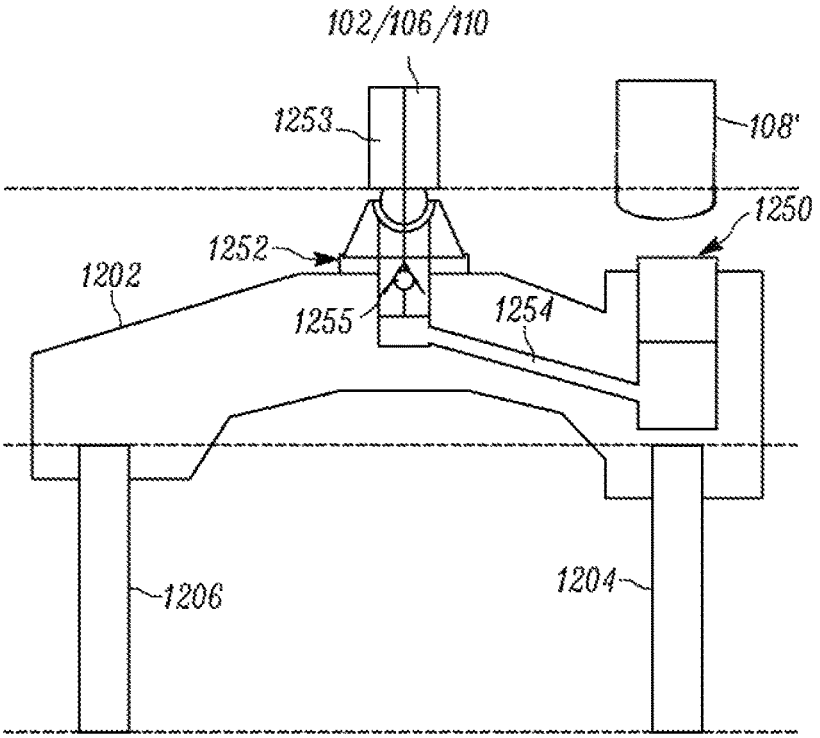
Figure 13:
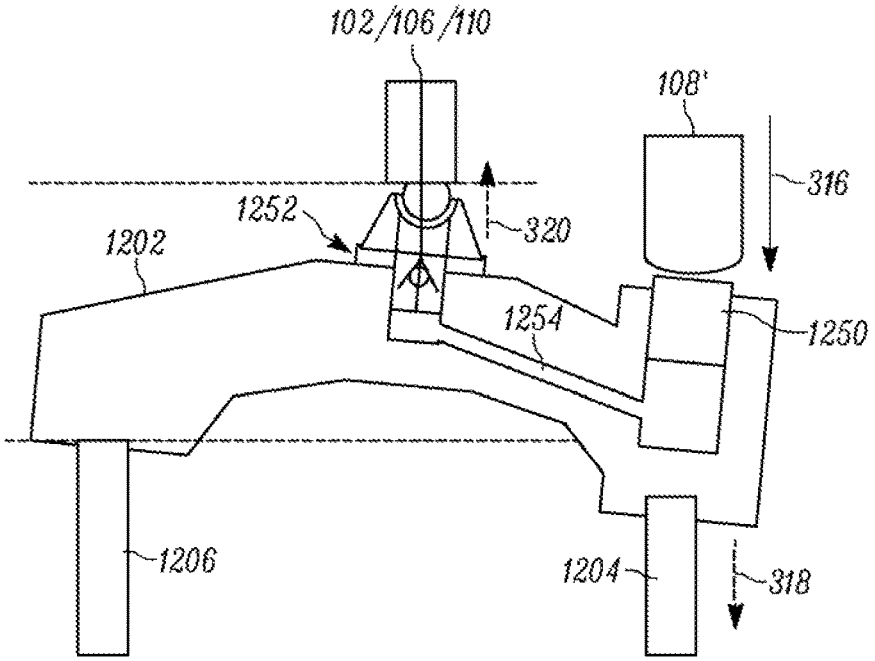
Figure 14:
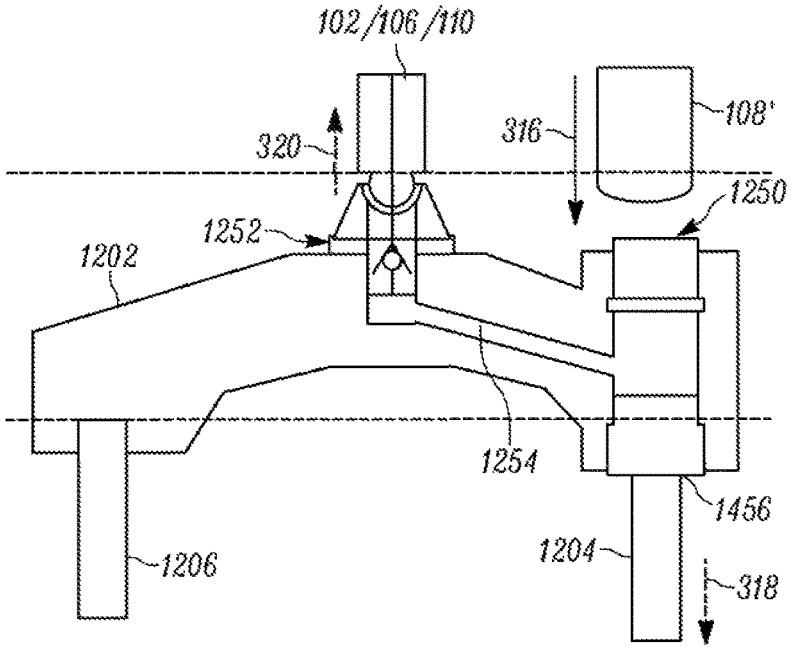

Referring now to FIGS. 12-14, various embodiments in which the linkage is implemented as an hydraulic linkage are further illustrated. With initial reference to FIGS. 12 and 13, a valve bridge 1202 is provided operatively connected to first and second engine valves 1204, 1206. In this embodiment, however, the valve bridge 1202 incorporates an hydraulic circuit 1254 in communication with a first bore having a first piston 1250 disposed therein and a second bore having a second piston 1252 disposed therein. Fluid to the hydraulic circuit 1254 may be supplied through suitable hydraulic passages 1253 formed in the main motion load path 106, as known in the art. Further, a check valve 1255, as also known in the art, may be provided to maintain pressure within the hydraulic circuit 1254 and prevent flow of hydraulic fluid back into the hydraulic passages 1253. As further shown, the first piston 1250 is configured to align with the auxiliary motion source 108' whereas the second piston 1252 is configured to align with the main motion source 102/main motion load path 106/automatic lash adjuster 110, as shown. When the hydraulic circuit 1254 is fully charged with hydraulic fluid, the first piston 1250 may operate as a master piston, whereas the second piston 1252 may operate as a slave piston. Thus, auxiliary motions applied to the first piston 1250 by the auxiliary motion source 108' cause the first piston 1250 to slide within the first bore, as shown in FIG. 13. Because the hydraulic circuit 1254 is substantially closed (i.e., hydraulic fluid therein takes a comparatively long time to leak out), the movement of the first piston 1250 is transferred to the second piston 1252, causing it to slide out of the second bore, as further shown in FIG. 13. In this manner, the second force may be applied to the main motion source 102/main motion load path 106/automatic lash adjuster 110. Using the principle of hydraulic force, the second force may be set through appropriate selection of the ratio of the area of the first piston 1250 to the area of the second piston 1252.

As further shown in FIG. 13, in addition to the second force transmitted through the second piston 1252, a first force is transmitted through the valve bridge 1202 to the first engine valve 1204. In particular, either the first or second piston 1250, 1252 is travel-limited (using means known in the art) such that, when the limit is reached, further movement from the aux motion source 108' induces rotation of the bridge 1202 rather than further translation of the pistons.

A further hydraulic embodiment is illustrated in FIG. 14. The embodiment of FIG. 14 is substantially similar to the embodiment of FIGS. 12 and 13, with the addition of a third piston 1456 residing in a third bore, which third bore is also in communication with the hydraulic circuit 1254. In this case, operation of the first and second pistons 1250, 1252 is substantially the same, whereas the third piston 1456 acts as an additional slave piston responsive to translation of the first piston 1250 (and again assuming that the hydraulic circuit 1254 is fully charged). That is, as the first piston 1250 translates response to the auxiliary motions, the third piston 1456 will also translate to provide the first force to the first engine valve 1204. Once again, appropriate selection of the respective areas of the first, second and third pistons 1250, 125, 1456 will dictate the magnitudes of the respective transmitted forces. In the embodiment illustrated in FIG. 14, both the first and third pistons 1250, 1456 are illustrated having shoulders that can engage with the body of the valve bridge 1202, thereby limiting travel and permitting main motions to be transmitted through the valve bridge 1202. An advantage of the embodiment of FIG. 14 is that the first force to the first engine valve 1204 may be transferred without rotation of the valve bridge 1202.

In each of the previously described embodiments of FIGS. 4-14, the use of a valve bridge across multiple engine valves has been assumed. However, that need not be the case in all instances, and the usage of a linkage as described herein can be equally applied to systems in which a valve bridge is not used, i.e., single valve system or simultaneous valve opening systems (subsequently referred to herein as a single valve system). Various examples of such embodiments are further illustrated in FIGS. 15-17.

Figure 15:
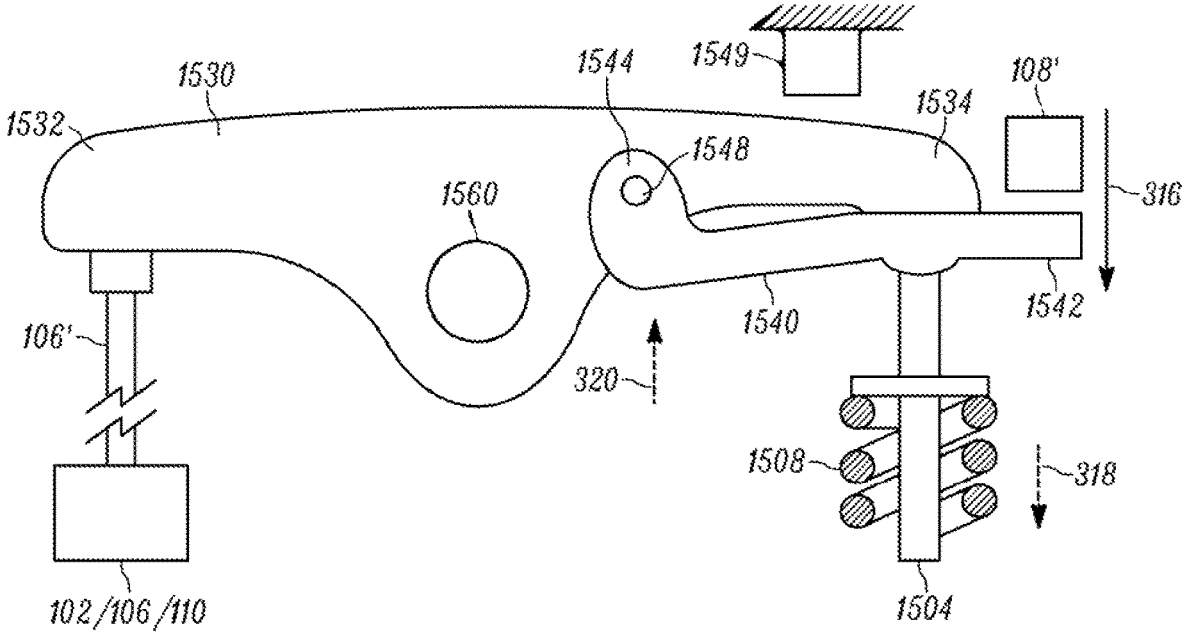
FIGS. 15-17 are schematic illustrations of various embodiments based on rocker arms in accordance with the instant disclosure.

Referring now to FIG. 15, a system is illustrated in which a at least one engine valve 1504 is actuated by a rocker arm 1530 that, in turn, receives auxiliary motions from a main motions source 102 via a main motion load path 106, which may further include an automatic lash adjuster 110. In accordance with prior art systems, the rocker arm 1530 may be rotatably mounted on a rocker arm shaft 1560. In the illustrated embodiment, the main motion load path 106 comprises a push rod 106' coupled to the rocker arm 1530 at a motion receiving end 1532 of the rocker arm 1530. A motion imparting end 1534 of the rocker arm 1530 imparts motions of the rocker arm 1530 to the engine valve 1504. As known, main motions induced in the rocker arm 1530 cause the engine valve 1504 to overcoming the closing force of a valve spring 1508.

The embodiment of FIG. 15 further illustrates a lever arm 1540 mounted on the motion imparting end 1534 of the rocker arm 1530. In particular, a first end 1542 of the lever arm 1540 is configured to align with the auxiliary motion source 108', whereas a second end 1544 of the lever arm 1540 is connected to the rocker arm 1530 by a pivoting connection 1548. As before, the pivoting connection 1548 may be implemented using any of a number of suitable connection mechanisms as described above. As further shown in FIG. 15, the motion imparting end 1534 of the rocker arm 1530 contacts the lever arm 1540 at a point intermediate to the first and second ends 1542, 1544 of the lever arm 1540. At this same point, the lever arm 1540 also contacts the engine valve 1504. As shown, the second end 1542 of the lever arm 1540 is configured such that it receives the auxiliary motions at a location that is offset relative to a longitudinal axis of the engine valve 1504. As a result, the engine valve 1504, or valve bridge in the case of a two valve fulcrum rocker, serves as a fulcrum point for the lever arm 1540. When auxiliary motions are applied to the first end 1542 of the lever arm 1540, a first force is transmitted by the lever arm to the engine valve 1504 and a second force is transmitted back to the rocker arm 1530 by virtue of the second end 1544 and the pivoting connection 1548. Once again, the respective lengths of first and second ends 1542, 1544 relative to the fulcrum point can be configured to select the magnitudes of the respective first and second forces.

As further shown in FIG. 15, a travel limiter 1549 may be an integral part of the lever arm and is deployed relative to the rocker arm 1530 in order to limit movement induced in the rocker arm 1530 by the lever arm 1540, thereby limiting the second force applied to the automatic lash adjuster 110. Once again, such limits on the amount of travel applied back on the automatic lash adjuster 110 can control the change in extension of the automatic lash adjuster 110.

Figure 16:
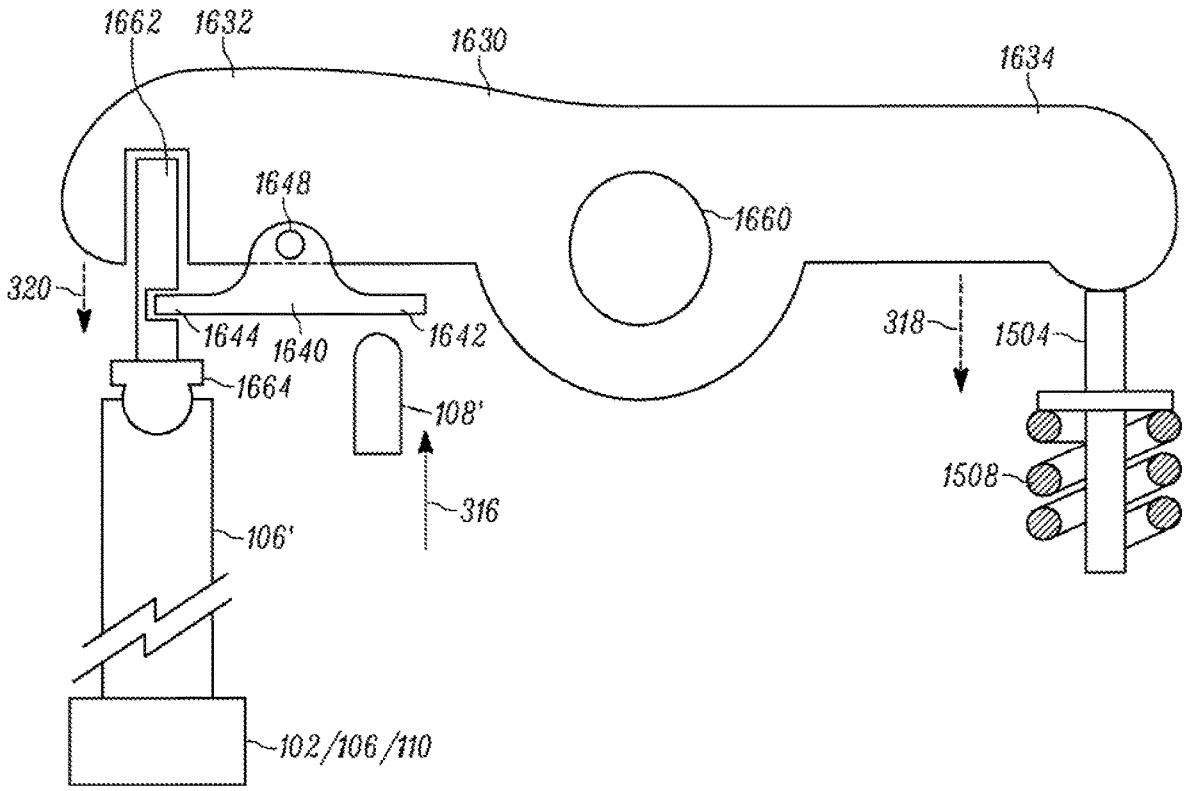

Referring now to FIG. 16, a single valve system is once again illustrated. In this embodiment, the at least one engine valve 1504 is driven by a motion imparting end 1634 of a rocker arm 1630. In contrast to the embodiment of FIG. 15, however, a lever arm 1640 is provided on a motion receiving end 1632 of the rocker arm 1630. As shown, the lever arm 1640 is coupled to the rocker arm 1630 by a pivoting connection 1648 intermediate a first end 1642 and a second end 1644 of the lever arm 1640. A sliding member 1662 is also provided in the motion receiving end 1632 of the rocker arm 1630, which sliding member 1662 is connected to the second end 1644 of the lever arm 1640. A suitable coupling 1664 operatively connects the sliding member 1662 to the push rod 106'. During positive power operation, motions received along the main motion load path 106 are transmitted through the push rod 106', through the coupling 1664 and sliding member 1662 to the rocker arm 1630 and, finally, to the engine valve 1504.

During an auxiliary operation, however, the auxiliary motion source 108' (which may comprise, in this example, a piston or like mechanism used to activate decompression of a give cylinder) applies auxiliary motions to the first end 1642 of the lever arm 1640, which then rotates about the pivoting connection 1648, thereby causing the sliding member 1662 and coupling 1664 to transmit the second force in the direction of the main motion source 102/main motion load path 106/automatic lash adjuster 110. In this embodiment, travel of the lever arm 1640 may be limited by contact of the first end 1642 of the lever arm 1640 with the rocker arm 1630, once again limiting the second force thus applied.

Figure 17:
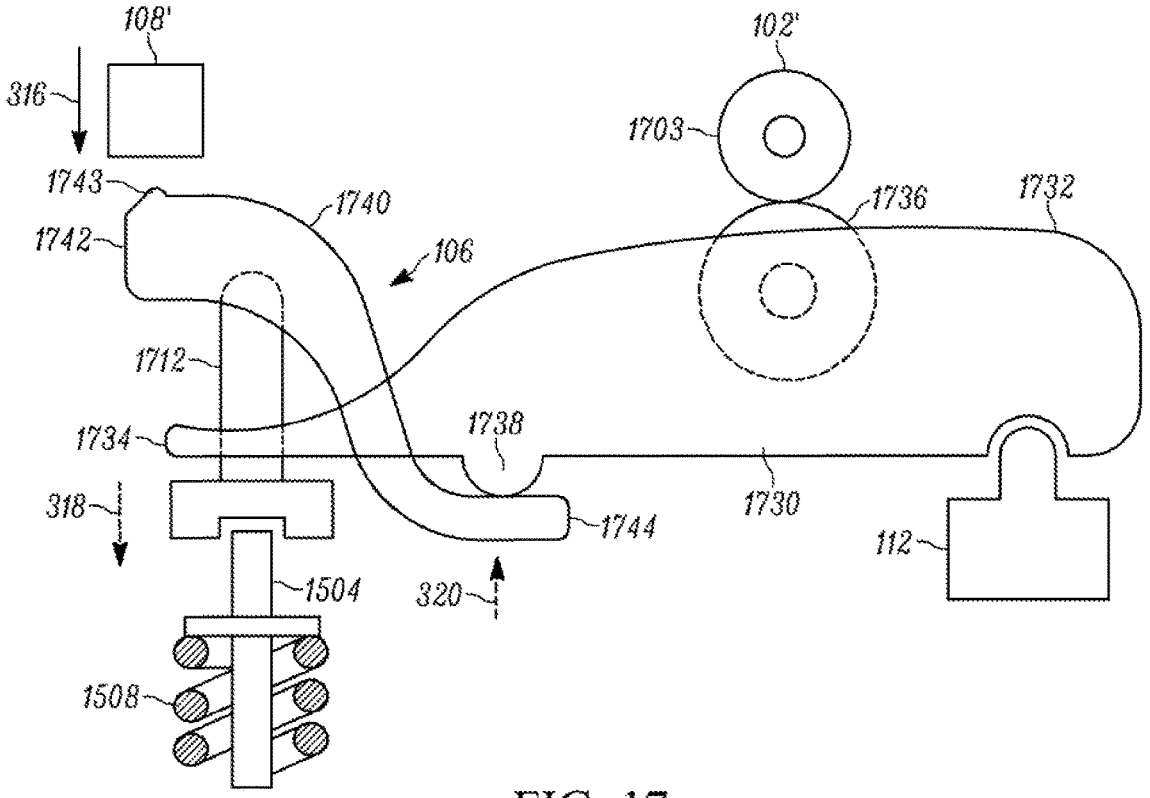

Finally, reference is made to FIG. 17, which illustrates an example of a system in which an automatic lash adjuster 112 is deployed in parallel to a main motion load path 106. In particular, FIG. 17 illustrates an example of a so-called finger follower often found in overhead cam engine configurations. In particular, the system comprise a main motion source 102' in the form of a cam having various lobes 1703, as known in the art. In turn, the main motion source 102' contacts a finger follow 1732 via a roller 1736 thereof. An hydraulic lash adjuster 112 is disposed at a first end of the finger follower 1732 whereas an opposite end of the finger follower 1732 imparts motions received from the main motion source 1732 to the at least one engine valve 1504. In the illustrated embodiment, the end of the finger follower 1732 contacting the engine valve 1504 includes an opening through which a sliding pin 1712 is permitted to pass through. The sliding pin 1712 is operative connected to both the engine valve 1504 and a lever arm 1740. The lever arm has a first end 1742 aligned to receive auxiliary motions from the auxiliary motion source 108' via an auxiliary motion receiving surface 1743. It is noted, once again, that the auxiliary motion receiving surface 1743 is offset relative to a longitudinal axis of the both the sliding pin 1712 and engine valve 1504. The lever arm 1740 includes an opening (not shown) that permits the finger follower 1732 to pass therethrough, and that further permits a second end 1744 of the lever arm 1740 to be positioned in proximity to a protrusion 1738 formed in a lower surface of the finger follower 1730.

During positive power operation, motions from the main motion source 102' are imparted on the roller 1736 and finger follower 1730 that, in turn, acts on the sliding pin 1712 and, finally, on the engine valve 1504. During auxiliary operation, however, the auxiliary motion source 108' applies auxiliary motions to the first end 1742 of the lever arm 1740, which then rotates about an upper end of the sliding pin 1712 serving as a fulcrum point for the lever arm 1740. This rotation of the lever arm 1740 cause the second end 1744 of the lever arm to contact the protrusion 1738, thereby transmit the second force to the finger follower 1730. This second force, then, induces rotation of the finger follower 1730 about its connection to the roller 1736 (clockwise in the illustrated example) and into contact with the automatic lash adjuster 112, thereby aiding in control of lash adjustment undertaken by the automatic lash adjuster 112. In this embodiment, travel of the finger follower 1730 may be limited by opening in the lever arm 1740, once again limiting the second force thus applied. As in all previous lever arm embodiments, the respective lengths of the first and second ends 1742, 1744 of the lever arm 1740 may be chosen so as to tailor the mechanical advantage provided by the lever arm to deliver the desired magnitude of the second force.

While particular preferred embodiments have been shown and described, those skilled in the art will appreciate that changes and modifications may be made without departing from the instant teachings. It is therefore contemplated that any and all modifications, variations or equivalents of the above-described teachings fall within the scope of the basic underlying principles disclosed above and claimed herein.

What is claimed is:

1. A system for use in an internal combustion engine having at least one engine valve associated with a cylinder, the system comprising:

a main motion source configured to supply main event engine valve motions to the at least one engine valve along a main motion load path;

an auxiliary motion source configured to supply auxiliary engine valve motions to the at least one engine valve; and a lever arm configured to receive the auxiliary engine valve motions from the auxiliary motion source and provide a first force to the at least one engine valve and a second force, based on the auxiliary engine valve motions from the auxiliary motion source, to the main motion load path in a direction toward the main motion source.

2. The system of claim 1, wherein two engine valves are associated with the cylinder, the system further comprising:

a valve bridge operatively connected to the two engine valves and disposed within the main motion load path.

3. The system of claim 2, wherein the lever arm contacts the valve bridge and has a first end configured to receive the auxiliary engine valve motions from the auxiliary motion source and a second end configured to impart the second force.

4. The system of claim 3, wherein the lever arm is further configured to interact with a portion of the valve bridge as a fulcrum point.

5. The system of claim 4, the valve bridge further comprising a slidable bridge pin aligned with a first engine valve of the two engine valves, wherein the bridge pin is the fulcrum point.

6. The system of claim 4, wherein the second end of the lever arm is rotatably coupled to the valve bridge.

7. The system of claim 4, wherein the lever arm is rotatably coupled to the valve bridge at a connection point of the valve bridge and between the first end and the second end of the lever arm, wherein connection point is the fulcrum point.

8. The system of claim 4, wherein the lever arm is coupled to another component in the main motion load path.

9. The system of claim 4, wherein the second end of the lever arm is configured to be positioned between the valve bridge and another component in the main motion load path.

10. The system of claim 3, further comprising:

a resilient element between the lever arm and the valve bridge.

11. The system of claim 2, wherein an automatic lash adjuster is disposed within main motion load path and the valve bridge.

12. The system of claim 1, wherein an engine valve is associated with the cylinder, the system further comprising:

a rocker arm operatively connected to the engine valve and disposed within the main motion load path, wherein the lever arm contacts the rocker arm and has a first end configured to receive the auxiliary engine valve motions from the auxiliary motion source and a second end configured to impart the second force.

13. The system of claim 12, wherein the lever arm is further configured to interact with a portion of the engine valve as a fulcrum point.

14. The system of claim 12, wherein the lever arm is further configured to interact with a portion of the rocker arm as a fulcrum point.

15. The system of claim 12, wherein the second end of the lever arm is rotatably coupled to the rocker arm.

16. The system of claim 12, wherein the lever arm is operatively connected to another component in the main motion load path.

17. The system of claim 12, wherein the second end of the lever arm is configured to be positioned between the rocker arm and another component in the main motion load path.

18. The system of claim 12, wherein the lever arm contacts the rocker arm on a motion imparting end of the rocker arm.

19. The system of claim 12, wherein the lever arm contacts the rocker arm on a motion receiving end of the rocker arm.

20. The system of claim 12, further comprising a travel limiter positioned to limit travel of the rocker arm in response to the second force.

21. The system of claim 12, further comprising:

an automatic lash adjuster associated with the main motion load path.

22. The system of claim 21, wherein the lever arm is configured to apply the second force to the main motion load path at a point in the main motion load path between the automatic lash adjuster and the at least one engine valve.

23. The system of claim 21, wherein the second force is sufficient to control lash adjustment by the automatic lash adjuster.

24. In an internal combustion engine comprising at least one engine valve associated with a cylinder, a main motion source supplying main event engine valve motions to the at least one engine valve along a main motion load path, a method for actuating the at least one engine valve comprising:

applying a first force, based on auxiliary engine valve motions from an auxiliary motion source, to the at least one engine valve; and via a lever arm operatively connected to the auxiliary motion source and the main motion load path, applying a second force, based on the auxiliary engine valve motions received by the lever arm from the auxiliary motion source, to the main motion load path in a direction toward the main motion source.

25. The method of claim 24, wherein the main motion load path comprises an automatic lash adjuster associated therewith, wherein the second force is sufficient to control lash adjustment by the automatic lash adjuster.

* * * * *